US006845593B2

(12) United States Patent
Silverman

(10) Patent No.: US 6,845,593 B2
(45) Date of Patent: Jan. 25, 2005

(54) MOVABLE WINDOW FRAMES HAVING RETAINING LATCHES

(75) Inventor: Arthur Silverman, Warren, NJ (US)

(73) Assignee: Silverline Building Products Corp., North Brunswick, NJ (US)

( * ) Notice: Subject to any disclaimer, the term of this patent is extended or adjusted under 35 U.S.C. 154(b) by 0 days.

(21) Appl. No.: 10/086,587

(22) Filed: Mar. 1, 2002

(65) Prior Publication Data

US 2003/0163969 A1 Sep. 4, 2003

(51) Int. Cl.[7] ..... E04H 12/00
(52) U.S. Cl. ..... 52/655.1
(58) Field of Search ..... 52/656.9, 656.4, 52/656.5, 656.6, 655.1, 656.7

(56) References Cited

U.S. PATENT DOCUMENTS

| | | | | | |
|---|---|---|---|---|---|
| 749,201 | A | | 1/1904 | Knisely | |
| 1,238,854 | A | * | 9/1917 | Watson | 49/438 |
| 1,241,794 | A | * | 10/1917 | Schneider | 49/193 |
| 1,722,947 | A | * | 7/1929 | Watson | 49/388 |
| 1,743,935 | A | * | 1/1930 | Mendelsohn | 160/397 |
| 1,765,388 | A | * | 6/1930 | Watson | 160/369 |
| 1,767,487 | A | * | 6/1930 | Schneider | 49/388 |
| 1,832,847 | A | | 11/1931 | Lane | |
| 1,908,270 | A | | 5/1933 | Shaffer | |
| 2,201,105 | A | * | 5/1940 | Fabriani | 49/188 |
| 2,629,143 | A | | 2/1953 | Spector et al. | |
| 2,768,852 | A | * | 10/1956 | Hicks | 292/175 |
| 3,756,057 | A | | 9/1973 | Brooks, Jr. et al. | |
| 3,784,043 | A | * | 1/1974 | Presnick | 220/4.28 |
| 3,835,586 | A | | 9/1974 | Gates et al. | |
| 3,837,118 | A | | 9/1974 | Gross, Jr. et al. | |
| 3,866,380 | A | | 2/1975 | Benson | |
| 4,205,486 | A | | 6/1980 | Guarnacci | |
| 4,238,909 | A | | 12/1980 | Mutton | |
| 4,265,052 | A | | 5/1981 | Johnson et al. | |
| 4,341,048 | A | | 7/1982 | Minter | |
| 4,489,965 | A | | 12/1984 | Taylor | |
| 4,495,726 | A | | 1/1985 | Lindström | |
| 4,555,869 | A | | 12/1985 | Kenkel | |
| 4,612,727 | A | | 9/1986 | Eriksson | |
| 4,651,482 | A | | 3/1987 | Borys | |
| 4,791,756 | A | | 12/1988 | Simpson | |
| 4,919,185 | A | | 4/1990 | Comeau et al. | |
| 4,944,118 | A | | 7/1990 | Biro | |
| 4,949,506 | A | | 8/1990 | Durham, Jr. | |
| 5,018,263 | A | | 5/1991 | Stern | |
| 5,094,055 | A | | 3/1992 | Berdan | |
| 5,295,292 | A | | 3/1994 | Leopold | |
| 5,361,476 | A | | 11/1994 | Leopold | |
| 5,431,211 | A | * | 7/1995 | Guillemet | 160/381 |
| 5,450,701 | A | * | 9/1995 | White | 52/656.9 |
| 5,485,705 | A | | 1/1996 | Guillemet | |
| 5,547,011 | A | | 8/1996 | Dotson et al. | |
| 5,881,525 | A | | 3/1999 | Riegelman et al. | |
| 6,018,911 | A | | 2/2000 | Menegazzo | |
| 6,108,997 | A | | 8/2000 | Blais et al. | |

* cited by examiner

*Primary Examiner*—Leslie A. Braun
*Assistant Examiner*—Kofi Schulterbrandt
(74) *Attorney, Agent, or Firm*—Lerner, David, Littenberg, Krumholz & Mentlik, LLP

(57) ABSTRACT

A frame assembly for a window opening includes an elongated frame member made of roll-formed stock material having top and bottom edges, and a first wall extending between the top and bottom edges. The frame assembly includes a latch positioned adjacent the first wall and between the top and bottom edges of the frame member. The latch is slidable between extended and retracted positions. The first wall of the elongated frame member has a hole for accessing the latch. A lift inserted into the hole is engageable for selectively moving the frame assembly relative to a fixed window frame.

36 Claims, 12 Drawing Sheets

MOVABLE WINDOW FRAMES HAVING RETAINING LATCHES

BACKGROUND OF THE INVENTION

The present invention is related to windows and is particularly related to movable window frames having retaining latches.

A window opening typically includes a fixed frame and one or more movable frames mounted in the fixed frame. The movable frames may hold a pane of glass, plastic or a screen, and are generally movable relative to the fixed frame between open and closed positions. The movable frames typically include retaining latches that may be retracted for sliding the frame relative to the fixed frame.

There have been many developments related to movable window frames. U.S. Pat. No. 3,756,057 to Brooks, Jr. et al., the disclosure of which is hereby incorporated by reference herein, discloses a method for roll-forming sheet metal to form sections of a screen frame. In one embodiment, sheet metal is roll-formed into sections and the roll-formed sections are assembled together to construct a screen frame. During the roll-forming process, pressure is applied to the sheet metal by rolls of a roll-forming machine to form the sections of the frame.

U.S. Pat. No. 5,485,705 to Guillemet discloses a corner assembly for a screen frame. The corner assembly has a pair of arms connected to side members of the frame. During assembly, the side members are telescopically received over the arms of the corner assembly. Each corner assembly includes a slide member having a protrusion, and a button that is engaged to move the slide member from a retracted position to an extended position. In the extended position, the protrusion engages a recess in a fixed window frame for holding the screen frame in a stationary position.

Prior art methods for forming window frames typically result in a significant waste of material. One well-known prior art method uses a 16 foot piece of stock material that is roll-formed and then cut into five frame members, each having a length of three feet. This method leaves thousands of one foot sections that cannot be used, resulting in significant waste.

Other window frames are made of extruded metal parts, such as extruded metal frame members. These extruded parts are generally bulky, heavy and expensive. Moreover, window frames having extruded parts typically use complex latching mechanisms that must be coupled with the extruded parts.

Another problem with conventional roll-formed and extruded members for window frames relates to the substantial waste that occurs during the manufacturing process. Typically, after the window frame members are roll-formed or extruded, the members are re-cut to size the members to preferred lengths. The re-cutting process generates thousands upon thousands of smaller pieces that are unusable. Thus, there is a need for a process that minimizes or eliminates the amount of waste generated during the window frame assembly process.

There also remains a significant need for window frames made of materials that are lighter, less complex, less expensive and easier to work with. There is also a need for window frames that can readily incorporate latching mechanisms therein, without requiring complex parts or a complex linking arrangement. Furthermore, there is a need for methods for making window frame assemblies that reduce the amount of waste found with prior art methods.

SUMMARY OF THE INVENTION

In accordance with certain preferred embodiments of the present invention, a frame assembly for a window opening includes an elongated frame member made of roll-formed stock material having top and bottom edges, and a first wall extending between the top and bottom edges. The stock material is preferably sheet metal, such as aluminum or steel sheet metal. In certain preferred embodiments, the stock material has a thickness of approximately 0.045–0.060 cm. In more preferred embodiments, the stock material has a thickness of approximately 0.051–0.055 cm. The frame assembly also desirably includes a latch positioned adjacent the first wall and between the top and bottom edges of the frame member. The latch is slidable between extended and retracted positions.

In certain preferred embodiments, the stock material is stored on a coil that is unwound as the material is needed for roll-forming the frame members. Initially, the stock material is unwound from the coil. The material is then pre-punched and processed through the roll-former. Upon exiting the roll-forming process, the part is cut to exact length therefore creating no waste of material as occurs with the prior art methods described above.

The first wall of the elongated frame member desirable includes a hole extending therethrough for providing access to the latch. The frame assembly also may include a corner assembly for coupling the frame member with a second frame member, such as a side frame member of a four-sided window frame. The corner assembly desirably has a slot for enabling the latch to pass or slide at least partially therethrough. The frame member is preferably elongated and has a major axis extending the first and second ends. When the corner assembly is attached to an end of the frame member, the slot of the corner assembly preferably extends in a direction substantially parallel to the major axis of the frame member. In certain embodiments, the corner assembly has a pair of connector arms. A first one of the connector arms is insertable into the first end of the frame member and a second one of the connector arms is insertable into a lower end of the side frame member.

In preferred embodiments, the first wall includes a first hole extending therethrough adjacent the first end of the frame member and a second hole extending therethrough adjacent the second end of the frame member. The frame assembly also includes a second latch at the second end of the frame member that is opposite from the first latch. The first hole in the first wall provides access to the first latch and the second hole in the first wall provides access to the second latch. Each latch preferably includes at least one resilient element engaged therewith for normally urging the latches into extended positions.

In certain preferred embodiments, the frame member includes a second wall spaced from the first wall for defining an elongated channel. During manufacture of the frame assembly, the latch is at least partially inserted into the elongated channel between the first and second walls. The second wall desirably extends at least partially between the top and bottom edges of the frame member. In this embodiment, the first wall has a first opening at the first end of the frame member for receiving the first latch and a second opening at the second end of the frame member for receiving a second latch. The latches slide within the elongated channel between the first and second walls.

The elongated frame member is adapted to be coupled with two side frame members. In one embodiment, a first side frame member is positioned at the first end of the elongated frame member and a second side frame member is positioned at the second end of the elongated frame member. The assembly includes a first corner assembly for coupling the first side frame member with the first end of the elongated frame member and a second corner assembly for coupling the second side frame member with the second end of the frame member. The first and second corner assemblies include respective slots for enabling the first and second latches to selectively pass therethrough and/or slide therein. The first corner assembly desirably has a first connector arm insertable into the first opening at the first end of the elongated frame member and a second connector arm insertable into an opening at a lower end of the first side frame member. The second corner assembly desirably includes a first connector arm insertable into the second opening at the second end of the frame member and a second connector arm insertable into an opening at a lower end of the second side frame member.

In certain preferred embodiments, the latch desirably includes a projection at one end, a handle spaced from the projection, and an intermediate section extending between the projection and the handle. The projection of the latch is preferably passable through the slots of the corner assemblies.

The frame assembly may also include a lift insertable into either one of the first and second holes. The lift is typically engaged for selectively moving the frame assembly relative to a fixed window frame. For example, the lift may be engaged for moving the frame assembly from a closed position to an open position relative to a fixed frame. The lift desirably includes an end wall having an aperture so that the latch may be passable through the aperture. When the handle of the latch is coupled with the elongated frame member, the handle is at least partially surrounded by the lift. As noted above, a resilient element is preferably in contact with the latch for normally urging the latch into an extended position for holding the elongated frame assembly in a stationary position relative to a fixed frame. In one particular preferred embodiment, the intermediate section of the latch includes an elongated slot for holding the resilient element. In other preferred embodiments, the latch is an elongated rod having an enlarged projection at one end, an attachment knob spaced from the enlarged projection, and an intermediate section extending therebetween. The knob of the elongated rod includes a neck for coupling with an underside of a handle. The resilient element may be a cylindrically wound compression spring that surrounds at least the intermediate section of the elongated rod.

Another embodiment of the present invention provides a window frame assembly including a top frame member, a bottom frame member, and first and second side frame members extending between the top and bottom frame members, whereby each of the frame members are connected to an adjacent frame member by a corner assembly. At least one of the top and bottom frame members is made of a roll-formed stock material, at least one of the roll-formed frame members having top and bottom edges extending between first and second ends thereof and a first wall extending between the top and bottom edges. The window frame assembly also desirably includes at least one latch positioned between the top and bottom edges of the roll-formed frame member. The latch is slidable between extended and retracted positions. In certain preferred embodiments, the window frame assembly includes a first latch positioned at a first end of the roll-formed frame member, and a second latch positioned at a second end of the roll-formed frame member spaced from the first end. The first wall of the roll-formed frame member includes at least one hole extending therethrough for providing access to either the first latch or the second latch. Other preferred embodiments include a first hole extending through the first wall adjacent to first end thereof and a second hole extending through the first wall at a second end thereof, with the first and second latches being accessible through the respective first and second holes.

In certain preferred embodiments, the window frame assembly includes a second wall spaced from the first wall for defining an elongated channel, with the one or more latches being slidable in the elongated channels. The second wall is preferably integrally connected with the first wall (i.e., made of the same piece of stock material). Thus, a second latch may be positioned in the elongated channel at an opposite end of the roll-formed frame member from the first latch. The window frame assembly also desirably includes a lift insertable into the first and/or the second hole. The lift is engageable for moving the window frame assembly relative to a fixed frame of a window opening. The lift desirably includes a bottom, and sidewalls extending upwardly from the bottom to a lip. At least one of the walls extending between the bottom and the lip includes an aperture for enabling the latch to pass at least partially therethrough. A resilient element is desirably in contact with the latch for normally urging the latch into an extended position.

Another preferred embodiment of the present invention includes a window frame assembly having a strip of stock material roll-formed into a first frame member having spaced first and second walls extending between first and second ends thereof. The frame member has at least one hole extending through the first wall adjacent one of the first and second ends, and a slidable latch positioned between the first and second walls and accessible through the hole in the first wall. The latch is desirably slidable between extended positions for holding the frame assembly stationary and retracted positions for moving the frame assembly relative to a fixed frame. The frame assembly also desirably includes a corner assembly connected to the first end of the frame member. The corner assembly has a slot for enabling the latch to pass therethrough. A lift is secured in the hole in the first wall of the frame member, the lift being engageable for moving the frame assembly. The first frame member may also include a second hole extending through the first wall at the second end thereof. The assembly further includes a second latch positioned between the first and second walls and accessible through the second hole extending through the first wall of the frame member.

These and other preferred embodiments of the present invention will be described in more detail below.

BRIEF DESCRIPTION OF THE DRAWINGS

FIGS. 1-1A to 1-1E show a lift for assembly with the frame of FIG. 1, in accordance with certain preferred embodiments of the present invention.

FIGS. 20A-1 shows a cross-sectional view of FIG. 20A taken along line 20A-1—20A-1 thereof.

FIGS. 20B-1 shows a cross-sectional view of FIG. 20B taken along line 20B-1—20B-1 thereof.

DETAILED DESCRIPTION

Figure 1:
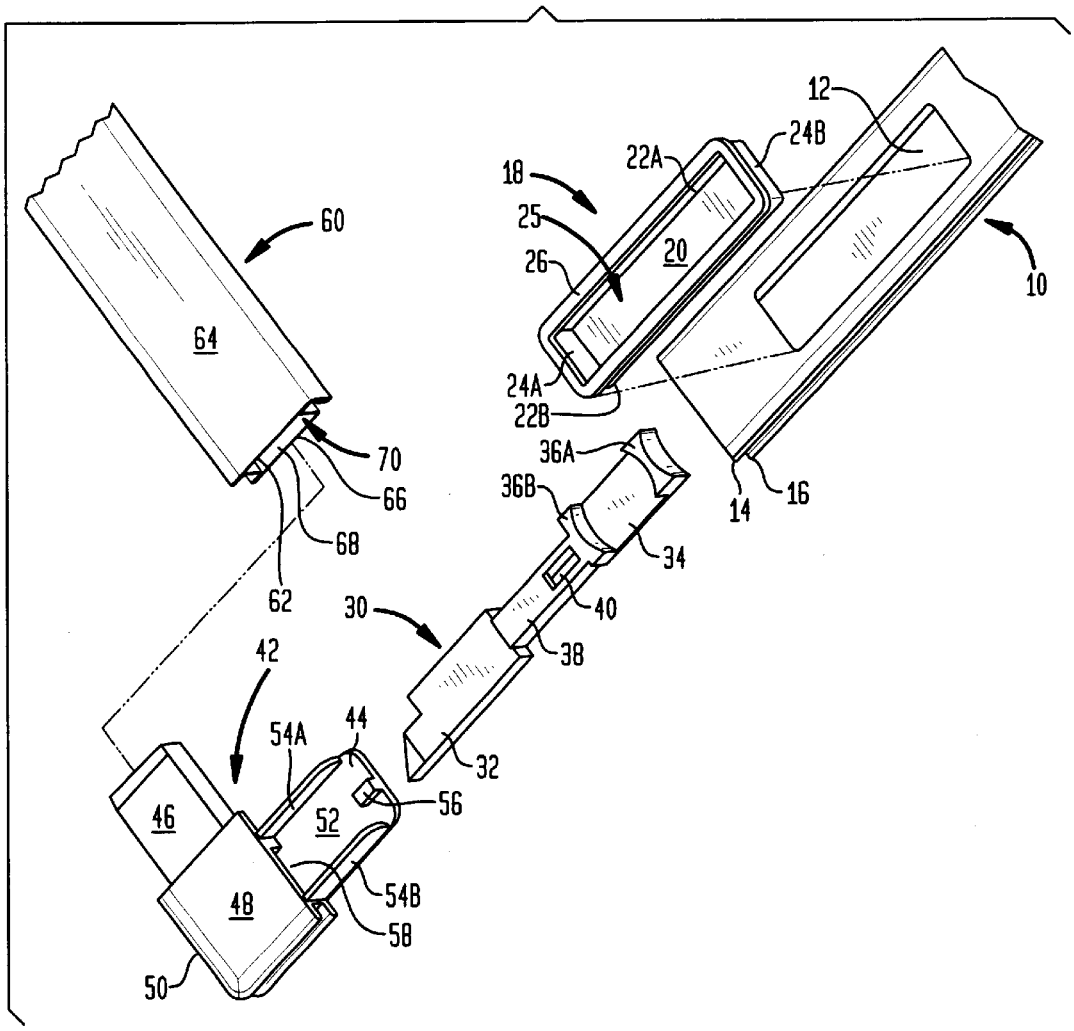
FIG. 1 shows an exploded partial view of a window frame with a latching assembly, in accordance with certain preferred embodiments of the present invention.

Referring to FIG. 1, in certain preferred embodiments of the present invention, a movable frame for a window includes an elongated frame member 10 having at least one hole 12 extending through a first wall 14. The frame member 10 has a second wall 16 that opposes the first wall 14. The frame member 10 is preferably made from stock material, such as steel or aluminum, that is roll-formed into a substantially rigid, elongated frame member 10 suitable for use in a movable window frame, such as a screen frame. The frame member 10 may be used as a top frame member at a top of the window frame or as a bottom frame member at a bottom of the window frame.

The frame member is preferably formed using well-known roll-forming techniques such as those disclosed in the above-mentioned U.S. Pat. No. 3,756,057. The stock material is desirably pre-cut to preferred lengths before commencing the roll-forming process, which minimizes the waste problems noted above (e.g., accumulating thousands of one foot sections). In preferred embodiments, the stock material has a thickness of approximately 0.045–0.060 cm. In more preferred embodiments, the stock material has a thickness of 0.049–0.055 cm. In highly preferred embodiments, the stock material has a thickness of about 0.053 cm.

In a first preferred embodiment (FIGS. 1, 2 and 5), the one or more holes 12 are punched in the stock material before the stock material is roll-formed into a frame member. Each hole 12 is preferably elongated or substantially rectangular in shape. During the roll-forming process, the strip of sheet material is preferably bent into an elongated frame member having a first wall 14 and a second wall 16 that opposes first wall 14, with hole 12 extending through first wall 14. Certain preferred embodiments may have only first wall 14, with no second wall opposing the first wall. Although the present invention is not limited by any particular theory of operation, it is believed that punching one or more holes in the sheet material before the roll-forming step simplifies the manufacturing process, reduces the number of parts required and lowers the overall cost of manufacturing a screen frame.

In a second preferred embodiment, the one or more holes in the frame member are punched after the roll-forming process. In this embodiment, a backup, die or mandrel may be used for punching the one or more holes.

Figures 1, 1A:
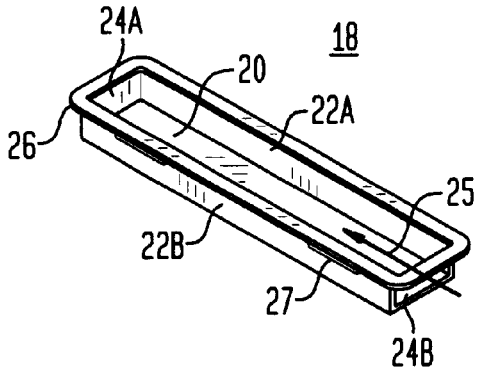
Figures 1, 1B:
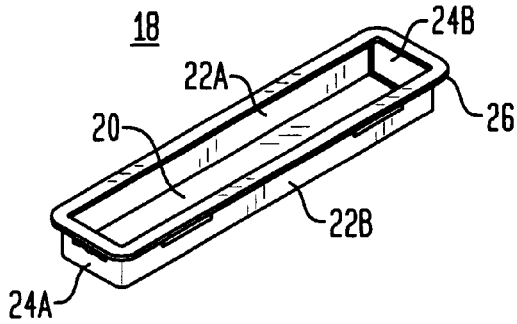
Figures 1, 1C:
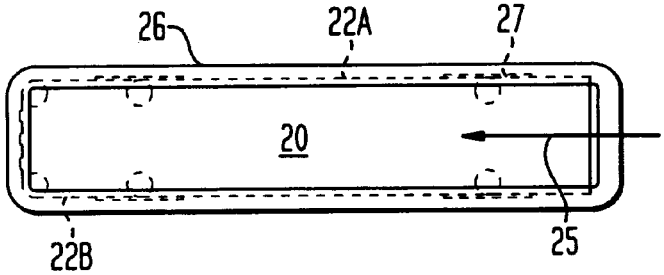
Figures 1, 1D:
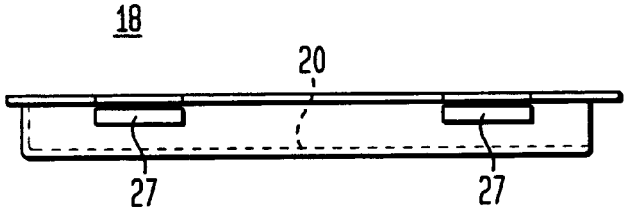
Figures 1, 1E:
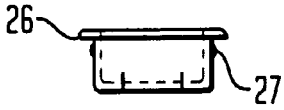
Figures 1, 1F:
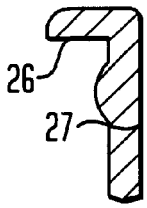

Referring to FIGS. 1-1A to 1-1F, the screen frame of the present invention also preferably includes a lift 18 insertable into hole 12 (FIG. 1) for facilitating lifting and lowering of the frame. Lift 18 desirably includes bottom 20, opposing sidewalls 22A, 22B, and opposing end walls 24A, 24B. The bottom 20, sidewalls 22A, 22B and end walls 24A, 24B define an elongated passageway 25 through which at least a portion of a slidable latch may pass, as will be described in more detail below. Lift 18 also preferably includes a lip 26 spaced from bottom 20 and extending from upper ends of sidewalls 22A, 22B and end walls 24A, 24B. In preferred embodiments, end wall 24A has an aperture through which a slidable latch may pass. When lift 18 is inserted into hole 12, the exterior surfaces of sidewalls 22A, 22B and end walls 24A, 24B may slide closely by the inner edges of hole 12. The sidewalls 22A, 22B of lift 18 include projections 27 (FIGS. 1-1D, 1-1E and 1-1F) adapted to positively connect the lift 18 to the hole 12 of the frame member 10. During assembly, the lift 18 is inserted into the hole 12 until projections 27 engage the inner edges of hole 12. At that point, the sidewalls 22A, 22B flex inward for allowing the projections 27 pass the inner edges of the hole 12. After the projections 27 pass the inner edges of the hole 12, the sidewalls 22A, 22B are free to return to their normal, undeflected state. When the lift 18 is fully inserted into the hole 12, the lip 26 of lift 18 preferably engages surface 28 of first wall 14, with projections 27 preventing lift 18 from backing out of hole 12.

Referring to FIG. 1, the movable frame also preferably includes a latching assembly having a slidable latch 30 with a projection member 32 adapted to slide through end wall 24A of lift 18. Latch 30 is slidable between an extended position for holding the movable frame in a stationary position relative to a fixed window frame and a retracted position for enabling the movable frame to move relative to the fixed window frame. Slidable latch 30 also includes a handle 34 having opposing knob elements 36A, 36B that enable a user to slide the latch 30 within the elongated passageway 25 of lift 18. Latch 30 also includes an intermediate section 38 extending between projection 32 and handle 34. Intermediate section 38 includes a window 40 and an elongated channel (FIG. 8) extending along an underside thereof. As will be described in more detail below, the elongated channel is preferably designed to receive a resilient element, such as a compressible spring, that normally urges the latch 30 into an extended position for holding the frame in place. The projection 32, intermediate section 38 and handle 34 are preferably integrally connected to one another. In preferred embodiments, the handle 34, projection 32 and intermediate section 38 comprise an integrally molded polymer such as plastic. In other preferred embodiments, the handle 34, projection 32 and intermediate section 38 comprises an integrally formed metal.

The movable frame also preferably includes a corner assembly 42 having a first connector arm 44 and a second connector arm 46. The first and second connector arms are sized to form a snug fit with adjacent frame members. In certain embodiments, the first and second connector arms 44, 46 extend in directions that are substantially perpendicular to one another. In other preferred embodiments, the connector arms extend along axes that cross one another. In particular preferred embodiments, corner assembly 42 is a molded plastic material with connector arms 44, 46 integrally connected with a corner section 48. Corner assembly 42 has a slot 58 that extends through outer peripheral wall 50 thereof for allowing projection 32 to pass therethrough as latch assembly 30 moves between retracted and extended positions. First connector arm 44 includes a bottom wall 52 bounded by opposing guide walls 54A, 54B. First connector arm 44 also includes an integrally formed projection 56 at an outer end thereof that is sized and shaped to slide within the window 40 of slidable latch 30. Projection 56 preferably serves to guide sliding movement of latch 30 relative to corner assembly 42. The distance between the interior surfaces of opposing guide walls 54A, 54B is substantially similar to the major width $W_1$ of projection 32. In operation, the guide walls 54A, 54B engage the major width $W_1$ of latch for guiding sliding movement of the latch relative to the first connector arm 44.

The movable frame of the present invention also preferably includes an elongated side frame member 60. The side frame member 60 is desirably roll-formed into an elongated member including first wall 62 defining an interior surface 64 and second wall 66 defining an exterior surface 68. The first and second walls 62, 66 define an opening 70 at a lower end of side frame member that is sized and shaped to receive the second connector arm 46 of corner assembly 42. During assembly, the second connector arm 46 is telescopically received in opening 70 to couple corner assembly 42 and side frame member 60.

Figure 2:
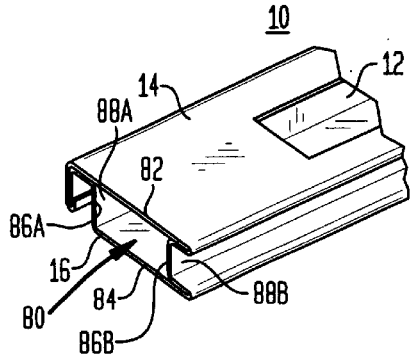
FIG. 2 shows a perspective end view of a frame member of the window frame of FIG. 1, in accordance with certain preferred embodiments of the present invention.
Figure 3:
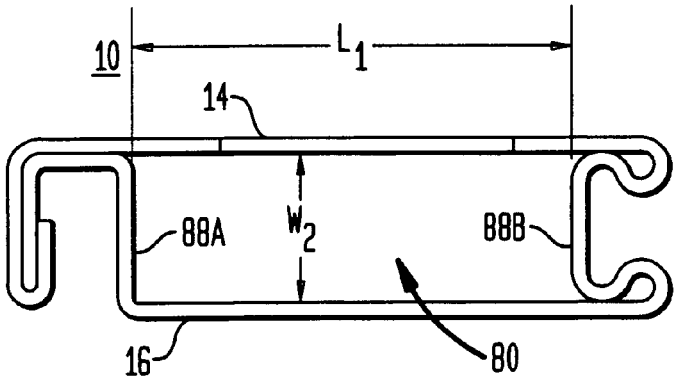
FIG. 3 shows an end view of the frame member of FIG. 2.

Referring to FIGS. 2 and 3, frame member 10 is an elongated roll-formed structure including first wall 14, second wall 16 that opposes first wall 14, and top and bottom edges 88A, 88B. The first wall 14, second wall 16 and top and bottom edges 88A, 88B of the roll-formed frame member 10 define an enclosed tubular channel therebetween having an opening 80. The opening 80 preferably extends between first and second walls 14, 16 and top and bottom edges 88A, 88B of frame member 10. The opening 80 preferably has a length $L_1$ of approximately 1.4–1.8 centimeters and a width $W_2$ of approximately 0.5–0.75 centimeters. The opening 80 is adapted to receive a portion of the slidable latch. In other preferred embodiments, the roll-formed frame member may have an elongated groove in lieu of second wall 16, whereby the latch slides in the elongated groove. In this embodiment, there is no enclosed tubular channel surrounding the slidable latch.

Figure 4A:
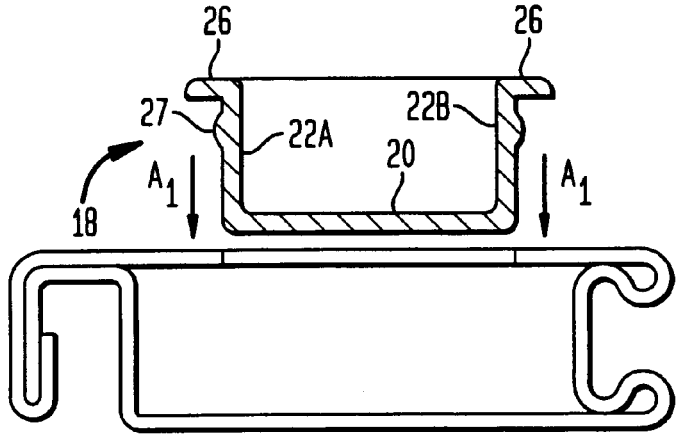
FIGS. 4A and 4B show a method of assembling the lift of FIGS. 1-1A with the frame member of FIG. 3.
Figure 4B:
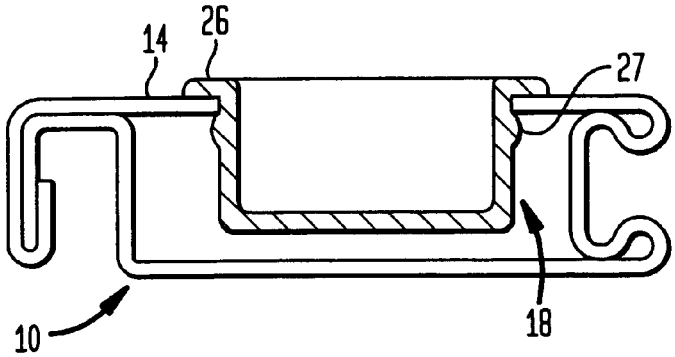

FIGS. 4A and 4B show the lift 18 of FIGS. 1 and 1-1A to 1-1F being assembled into the hole 12 formed in first wall 14. During assembly, lift 18 is inserted into hole 12 of frame member 10 by moving lift 18 in the direction indicated by arrows $A_1$. Referring to FIG. 4B, lift 18 is inserted into hole 12 until lip 26 abuts against the peripheral edge of hole 12. The projections 27 in sidewalls 22A, 22B closely engage the edges of hole 12 for positively securing lift 18 to frame member 10.

Although not limited by any particular theory of operation, it is believed that the roll-formed frame member of the present invention is made of stock material that is substantially thinner than prior art window or screen frames, which are typically extruded. Prior art extruded frames typically have a thickness of at least 0.10 cm. In contrast, the present invention uses stock material, such as aluminum or steel sheet metal, having a thickness of approximately 0.045–0.060 cm, and more preferably a thickness of approximately 0.049–0.055 cm, and even more preferably a thickness of approximately 0.053 cm. As a result, the movable frame of the present invention uses less material than is required for prior art window frames, resulting in a significant cost savings. The present invention also provides a more compact assembly than available in the prior art.

Figure 5:
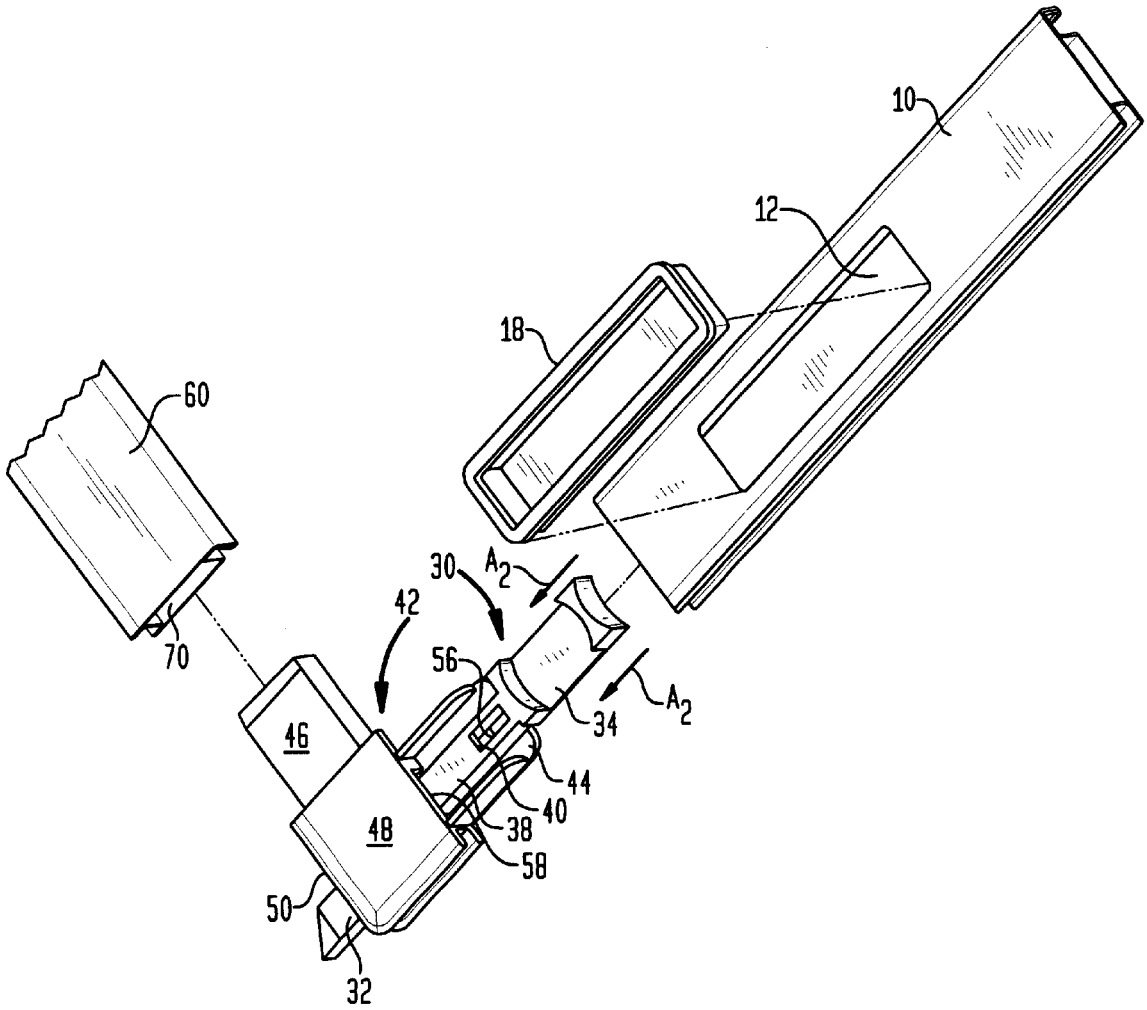
FIGS. 5–7 show a method for assembling the window frame of FIG. 1, in accordance with certain preferred embodiments of the present invention.
Figure 8:
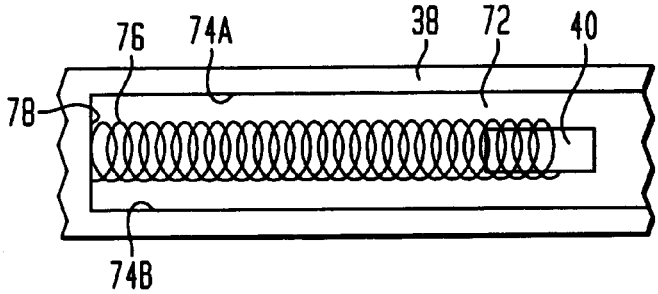
FIG. 8 shows a partial view of an underside of a slidable latch of the latching assembly of FIG. 1, in accordance with certain preferred embodiments of the present invention.

Referring to FIG. 5, during assembly, slidable latch 30 is assembled with corner assembly 42 by inserting projection 32 into slot 58, in a direction indicated by arrows $A_2$ As shown in FIG. 8, an underside of intermediate section 38 includes an elongated channel defined by sidewalls 74A, 74B. A resilient element, such as a spring 76, is inserted into channel 72. Spring 76 desirably extends between end wall 78 and window 40 of intermediate section 38. During assembly, spring 76 is preferably held in channel 72 until intermediate section 38 of latching assembly 30 contacts bottom wall 52 of first connector arm 44. At such time, spring 76 is held within channel 72 by opposing sidewalls 74A, 74B, end wall 78 and bottom wall 52 of first connector arm 44. Latch 30 is further inserted into corner 48 in the direction indicated by arrows $A_2$ until projection 56 of first connector arm 44 is captured within window 40 of intermediate section 38. Spring 76 is preferably engaged at a first end thereof by end wall 78 of intermediate section 38 and at a second end thereof by projection 56 of first connector arm 44. The force generated by spring 76 will normally urge latch 30 into an extended position. When latch 30 is retracted, the spring 76 is compressed between projection 56 of first connector arm 44 and end wall 78 of elongated channel 72.

Referring to FIG. 5, corner assembly 42 and latch 30 are preferably assembled with elongated side frame member 60 by inserting second connector arm 46 of corner assembly 42 into the opening 70 at the lower end of side frame member 60. As noted above, the outer perimeter of second connector arm 46 is preferably sized and shaped to fit snugly with the inner dimension of opening 70. In other preferred embodiments, an adhesive, resilient clips, screws and/or other fasteners may be used for forming a secure connection between corner assembly 42 and side frame member 60.

Figure 6:
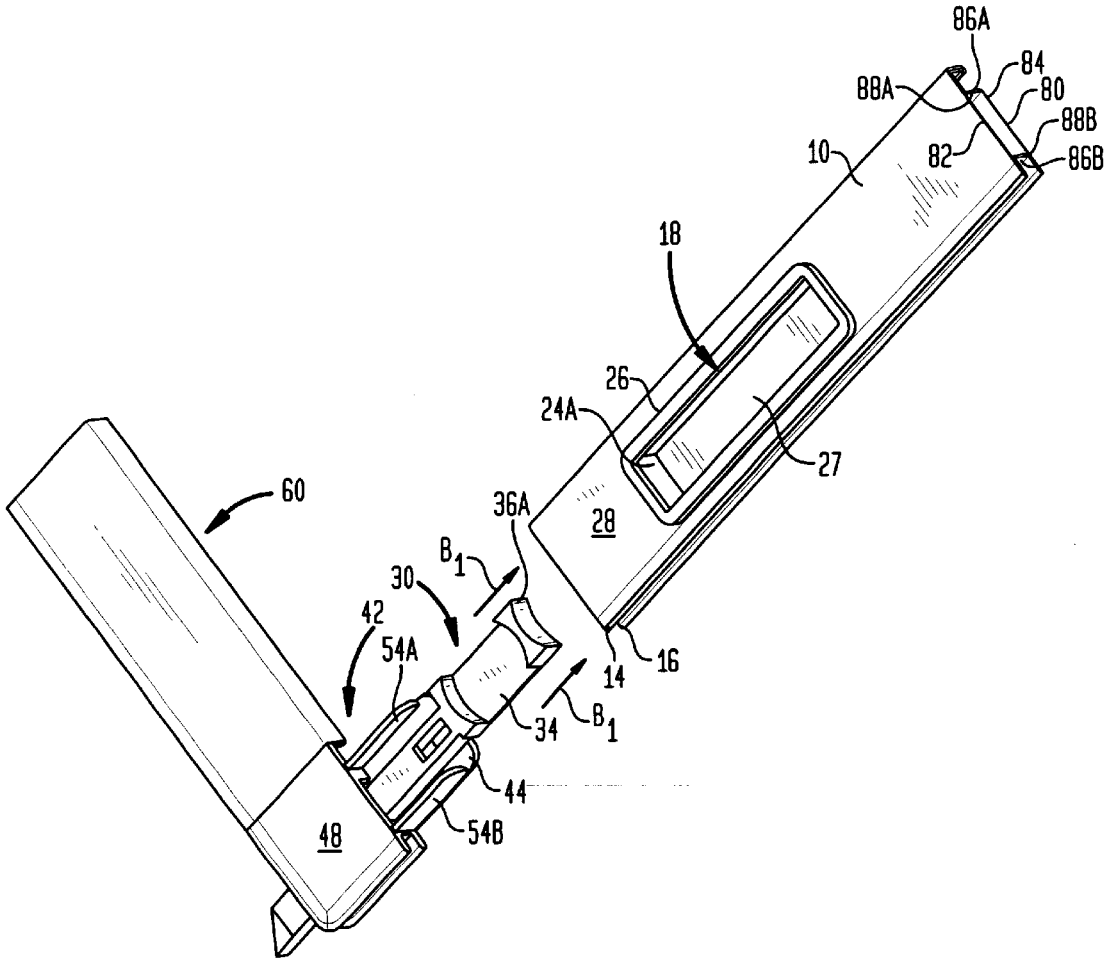

Referring to FIGS. 5 and 6, during further assembly, lift 18 is inserted into the hole 12 formed in first wall 14 of elongated frame member 10 until the lip 26 engages surface 28 (FIG. 5) of first wall 14. In certain preferred embodiments, the side walls 22A, 22B and end walls 24A, 24B of lift 18 engage the edge of hole 12. In more preferred embodiments, projections 27 (FIGS. 1-1F) on sidewalls 22A, 22B engage the edge of hole 12.

Referring to FIGS. 2 and 6, frame member 10 has an opening 80 defined by a first edge 82 of first wall 14, a second edge 84 of second wall 16 and top and bottom edges 88A, 88B, respectively. During assembly the handle 34 of latch 30 is inserted into opening 80 in the direction indicated by arrow $B_1$.

The distance between guide walls 54A, 54B of first connector arm 44 is approximately equal to the distance between top and bottom edges 88A, 88B of frame member 10. The guide walls 54A, 54B of first connector arm 44 preferably engage the top and bottom edges 88A, 88B of frame member 10 to create a friction fit between first connector arm 44 and frame member 10. As latch 30 and first connector arm 44 are inserted into opening 80, the handle 34 including knob 36A passes through opening 24A of lift 18.

Figure 7:
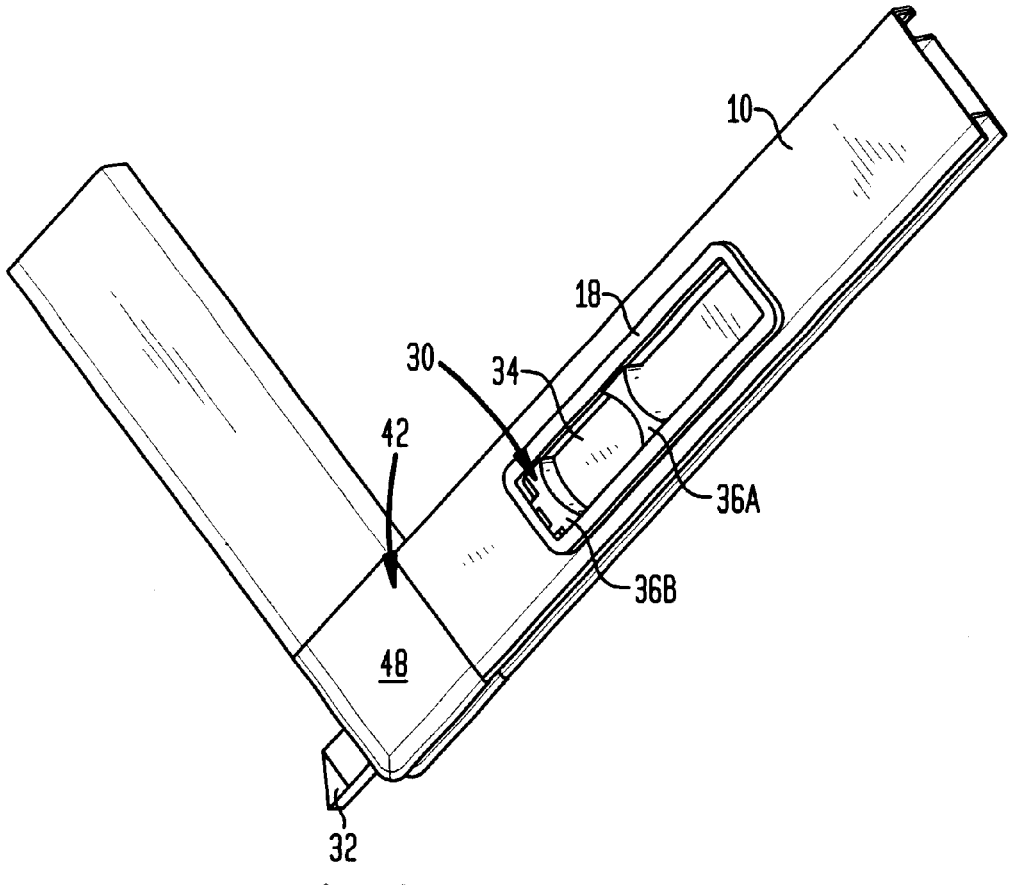

Referring to FIGS. 6 and 7, after latch 30 has been inserted into the opening 24A of lift 18, latch 30 is free to slide within elongated channel 25 of lift 18. In operation, the projection 32 of latch 30 may be retracted into the corner 48 of corner assembly 42 by engaging knobs 36A, 36B and applying a force in a direction indicated by arrow $C_1$. The force exerted upon the knobs 36A, 36B must be sufficient to overcome the tension force exerted by the spring 76 (FIG. 8). When projection 36 is retracted into corner 48, the frame assembly is free to move relative to a fixed window frame. In certain preferred embodiments, latching assemblies are located on opposite ends of elongated frame member 10. In these particular preferred embodiments, both of the opposing latching assemblies must be moved into retracted positions so that the frame assembly may move relative to a fixed window frame. After frame assembly is moved to a desired position relative to the fixed window frame, knobs 36A, 36B may be released, whereupon the force of the spring urges latch 30 into the extended position shown in FIG. 7. When in the extended position shown in FIG. 7, latch tip 32 projects into a hole punched in a fixed vertical window frame.

Figure 9:
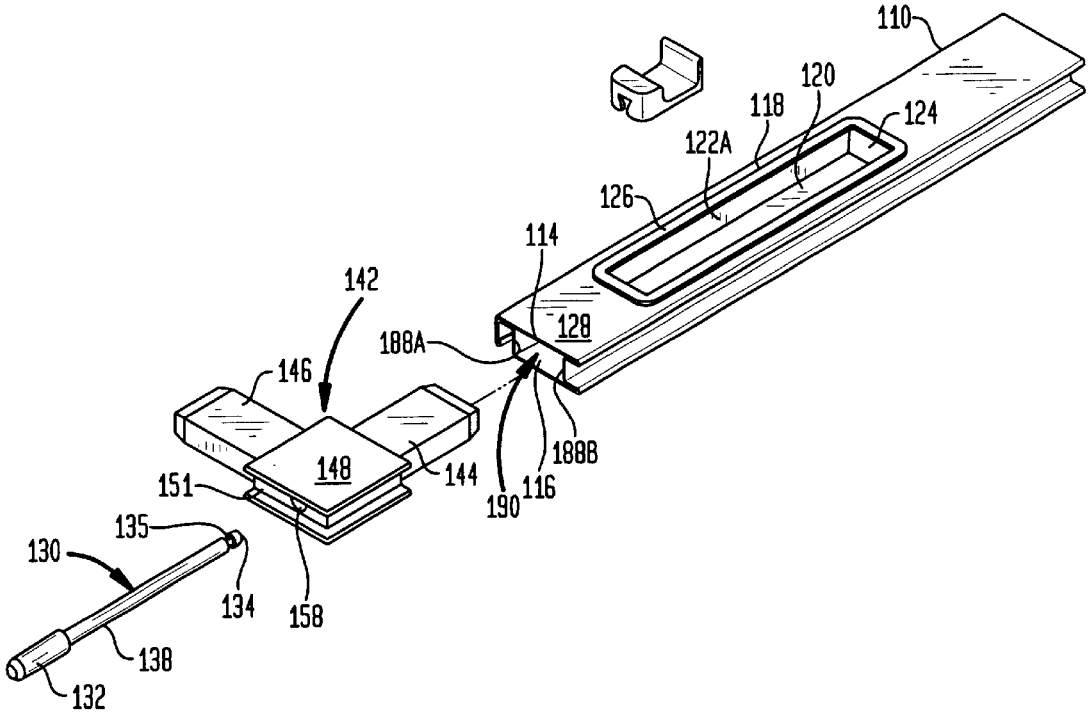
FIGS. 9–14 show a method of assembling a window frame with a slidable latch, in accordance with further preferred embodiments of the present invention.

Referring to FIG. 9, in another preferred embodiment of the present invention, a screen frame includes elongated frame member 110 having a first wall 114 and a second wall 116. Elongated frame member 110 has a top edge 188A and a bottom edge 188B opposing top edge 188A. The first wall 114, second wall 116, and top and bottom edges 188A, 188B define an opening 190 at a first end of frame member 110. The frame member 110 may be used as either the top frame member or the bottom frame member of a window frame assembly.

The window frame assembly of FIG. 9 also includes a hole (not shown) formed in first wall 114 of elongated frame member 110. The hole is substantially similar to the hole shown and described in FIG. 1. A lift 118, including bottom 120, first side wall 122*a*, second side wall (not shown), first end wall (not shown) and second end wall 124*b*, is inserted into the hole in first wall 114 until lip 126 engages interior surface 128 of first wall 114.

The window frame assembly of FIG. 9 also includes a corner assembly 142 having a first connector arm 144 and a second connector arm 146. The first and second connector arms 144, 146 extend in directions that are transverse to one another. Corner assembly 142 also includes corner 148 having a slot 158 extending therethrough in axial alignment with first connector arm 144. The slot 158 is sized and shaped to receive a rod 130 having an enlarged projection 132, an intermediate section 138, a reduced diameter neck 135 and a button 134. First connector arm 144 has an outer dimension that substantially matches the size of opening 190 so that first connector arm 144 fits snugly into the opening 190.

Figure 10:
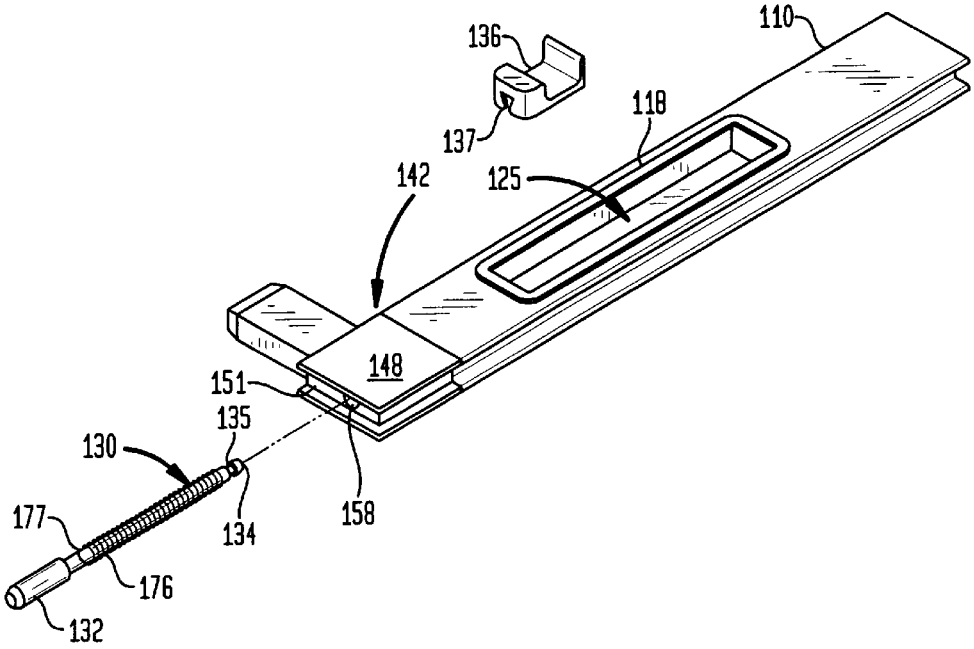
Figure 11:
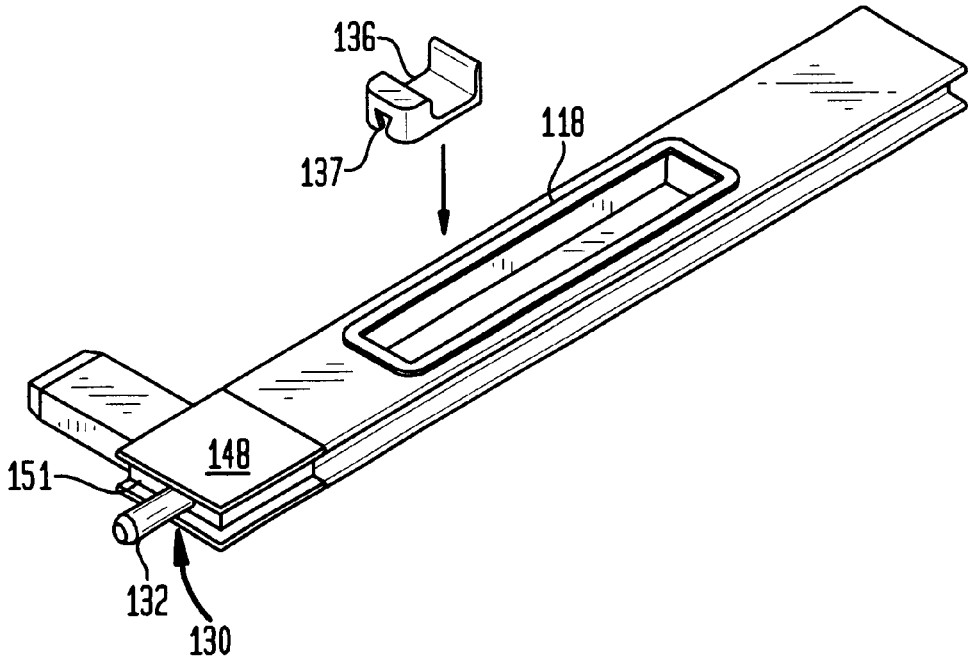

Referring to FIGS. 9 and 10, corner assembly 142 is assembled with frame member 110 by inserting first connector arm 144 into the opening 190 of frame member 110. A resilient element 176 is inserted onto rod 130 until an end 177 of the resilient element abuts against enlarged projection 132. The resilient element is preferably a compression spring that is assembled with the rod 130 between enlarged projection 132 and the reduced diameter neck 134 of the rod. With rod 130 in the extended position, enlarged projection 132 extends through the slot 158 in corner 148. Rod 130 and resilient element 176 are inserted into the slot 158 in corner 148 until button 134 and neck 135 are positioned within the elongated channel 125 of lift 118. A knob 136 having an inverted U-shaped opening 137 at an underside thereof is connected with rod 130 by snap fitting the U-shaped opening 137 over the neck 135.

Figure 12:
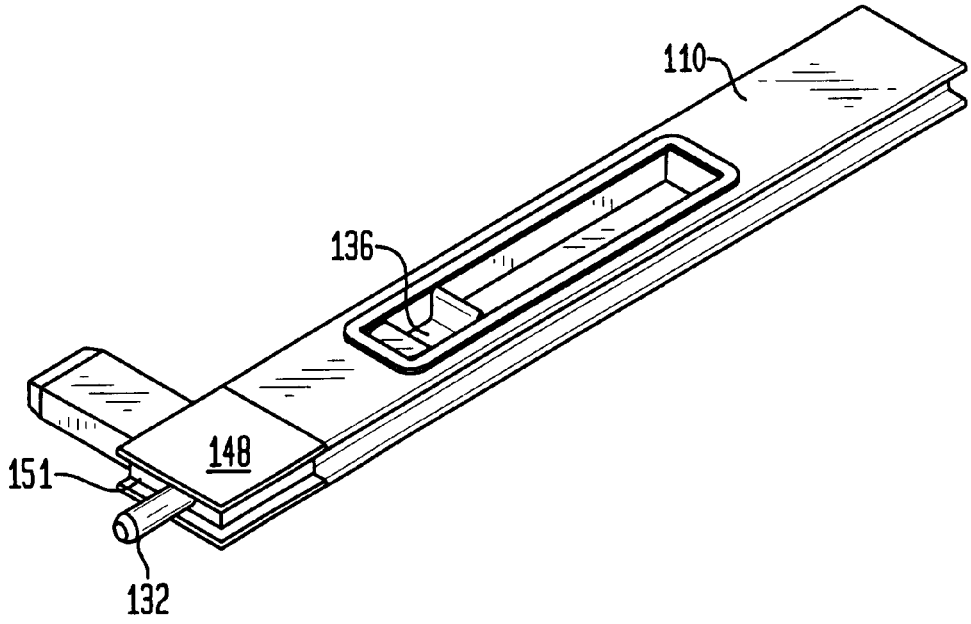
Figure 13:
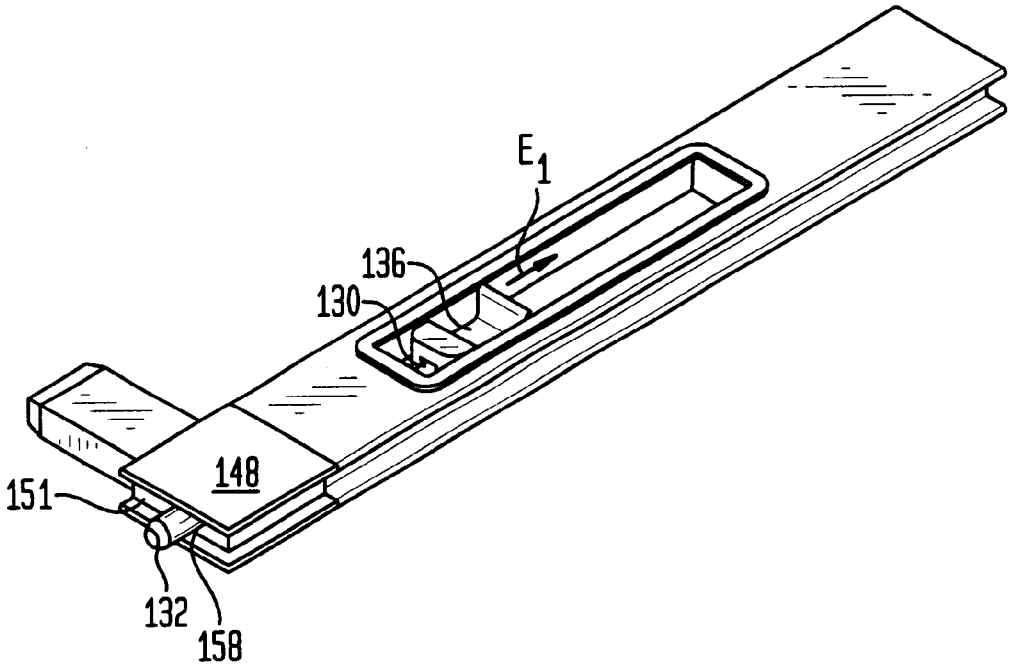
Figure 14:
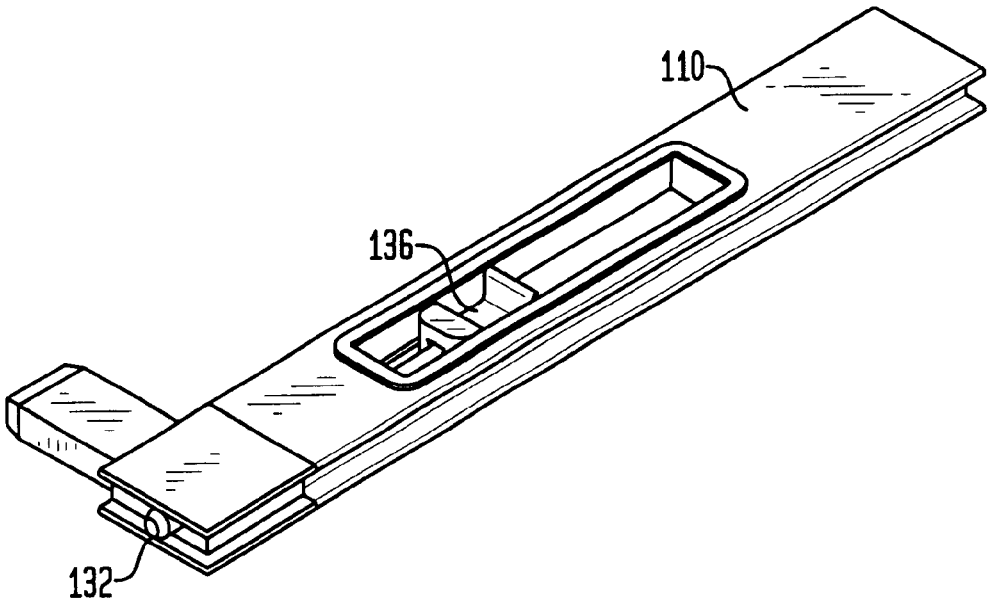

Referring to FIG. 13, the rod 130 including projection 132 may be retracted by applying a force to knob 136 to move knob 136 in the direction indicated by arrow $E_1$. As knob 136 moves to the right, the knob 136 pulls the rod 130 to the right as well. The knob 136 continues to be moved in the direction designated $E_1$ until the enlarged projection 132 is fully retracted into the position shown in FIG. 14, whereupon the window frame assembly is free to slide relative to a fixed window frame for opening, closing or positioning the frame assembly at a desired location relative to the fixed frame. Once the frame assembly is positioned at a desired location relative to the window frame, knob 136 may be released, whereupon the resilient element in engagement with rod 130 returns the enlarged projection 132 to the extended position shown in FIG. 12. In the extended position, the enlarged projection 132 engages the fixed window frame for preventing the frame assembly from moving.

As used herein, the combination of the rod 130, knob 136 and resilient element may be referred to as a "latch" or "latching assembly." The rod 130, knob 136 and resilient element perform substantially the same function as performed by the latch shown and described in FIGS. 1 and 5–7.

Figure 15:
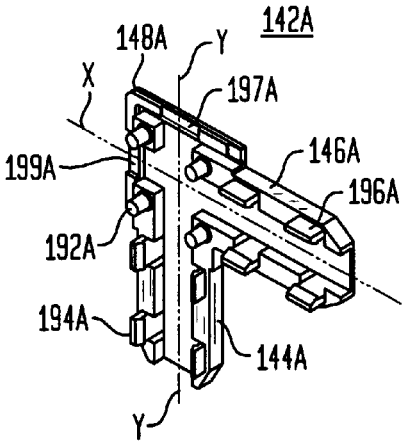
FIGS. 15–18 show a universal corner assembly and latch for a window frame, in accordance with certain preferred embodiments of the present invention.
Figure 16:
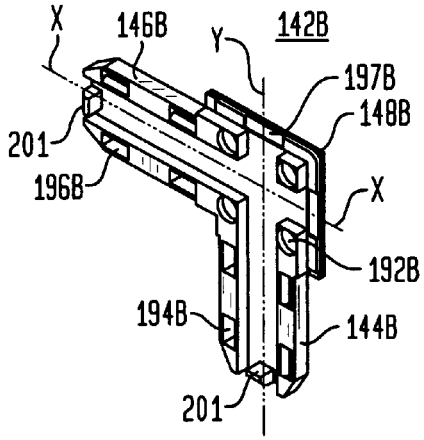
Figure 19A:
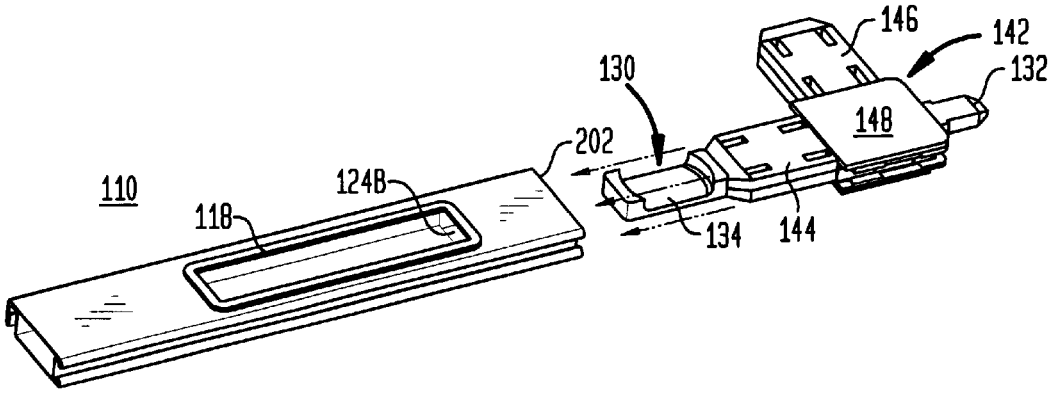
FIGS. 19A and 19B show the universal corner assembly of FIG. 18 connected to a frame member of a window frame.
Figure 19B:
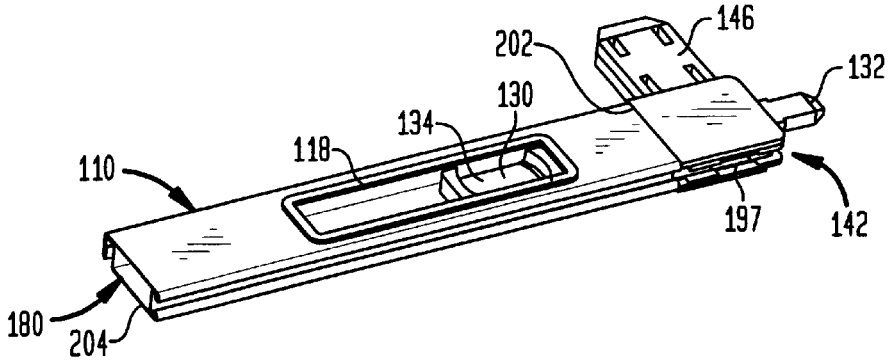

FIGS. 15 and 16 show first and second components of a universal corner assembly, in accordance with certain preferred embodiments of the present invention. The universal corner assembly may be connected with openings at either end of a frame member, as shown in FIGS. 19A and 19B. The corner assembly preferably includes first component 142A having first connector arm 144A and second connector arm 146A. The first component 142A includes first projections 192A adjacent the corner 148A, first connector arm projections 194A on first connector arm 144A, and second connector arm projections 196A on second connector arm 146A. First component 142A has a first slot 197A along the Y axis and a second slot 199A along the X axis. The first component 142A is designed to be snap fit with the second component 142B, shown in FIG. 16. The second component 142B includes first connector arm 144B having depressions 194B adapted to receive projections 194A. Second component 142B also includes second connector arm 146B including depressions 196B adapted to receive projections 196A. Second component 142B also includes depressions 192B formed adjacent corner 148B for receiving projections 192A. Second component 142A also has a first slot 197B in alignment with Y axis and a second slot 199B in alignment with X axis.

Referring to FIG. 16, the outer ends of first and second connector arms 144B, 146B, include abutments 201 that engage an end of a resilient element inserted into elongated channel 140 of latch 130.

Figure 17:
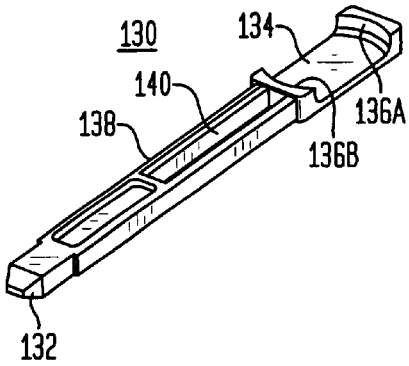

Referring to FIG. 17, a latch 130 is designed to move along either the X-axis or the Y-axis, depending upon which end of the frame member the corner assembly is connected with. Latch 130 includes projection 132, handle 134 having knobs 136A, 136B, and intermediate section 138 interconnecting projection 132 and handle 134. Latch 130 includes an elongated channel 140 formed in intermediate section 138.

Figure 18:
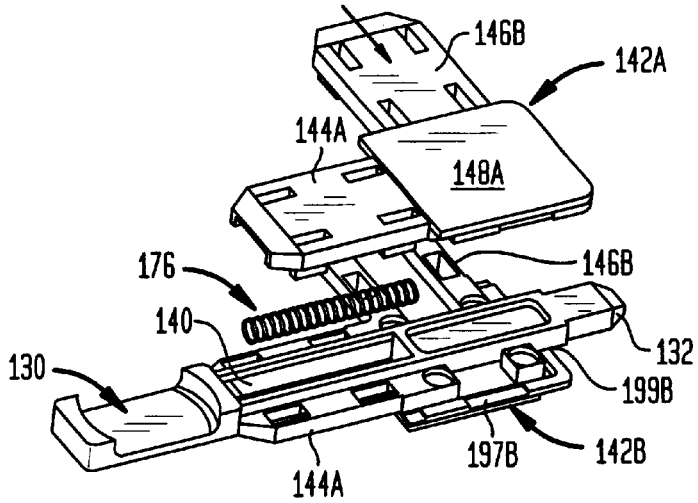

Referring to FIG. 18, in one preferred embodiment latch 130 is assembled with first and second components 142A, 142B by aligning latch 130 with the Y-axis of second component 142B. Resilient element 176 is placed in elongated channel 140 of latch 130 so that an end of resilient element 176 engages abutment 201 for normally urging latch 130 into an extended position. The first component 142A is snap fit to second component 142B by inserting the projections 192A, 194A, and 196A of first component 142A into the depressions 192B, 194B and 196B of second component 142B.

Referring to FIGS. 19A and 19B, corner assembly 142 is assembled with the second end 202 of frame member 110 by inserting first connector arm 144 into the opening (not shown) at the second end 202. During the assembly step, the handle end 134 of latch 130 passes through the opening at second end 202 of frame member 110. As the latch 130 passes through the opening at the second end 202, the handle 134 of latch 130 passes through the opening in the end wall 124B of lift 118. Referring to FIG. 19B, projection 132 of latch 130 normally extends beyond corner 148. Projection 132 may be retracted into corner assembly 142 by pulling handle 134 to the left to overcome the force of the resilient element (not shown) in engagement with latch 130. The corner assembly 142 may be assembled for insertion into the opening 180 at the first end 1204 of frame member 110 by placing the latch in slot 199 so that latch 130 slides along the X axis of second connector arm 146. In this second configuration, the second connector arm 146 is inserted into the opening 180 at the first end 204 of frame member 110.

Providing a universal corner assembly will reduce the number of parts required to assemble a complete window frame because the same components may be used for making corner assemblies connected to both the first and second ends 202, 204 of frame member 110. This will result in a substantial reduction in the number of dies required to manufacture the corner assemblies. Providing a universal corner assembly will also reduce the need to carry different parts in inventory, thereby resulting in a significant cost savings. In still other preferred embodiments, the universal corner assembly may have only one slot for the slidable latch, whereby the corner assembly may be positioned to have a first surface facing up when being connected to a first end of the frame member, and then flipped over so that a second surface faces up for being connected to a second end of the frame member.

Figures 1, 20A:
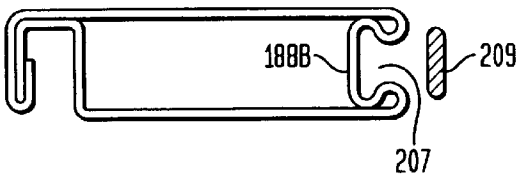
FIG. 20A shows a perspective view of the frame member and corner assembly of FIG. 19B including an insulating strip insertable into a T-shaped groove extending along a bottom edge of the frame member and the corner assembly.
Figures 1, 20B:
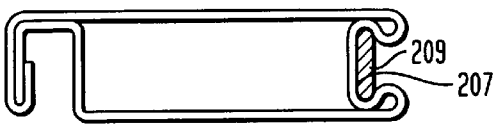
FIG. 20B shows the insulting strip of FIG. 20A inserted into the T-shaped groove extending along the bottom edge of the frame member of FIG. 20A.
Figure 20A:
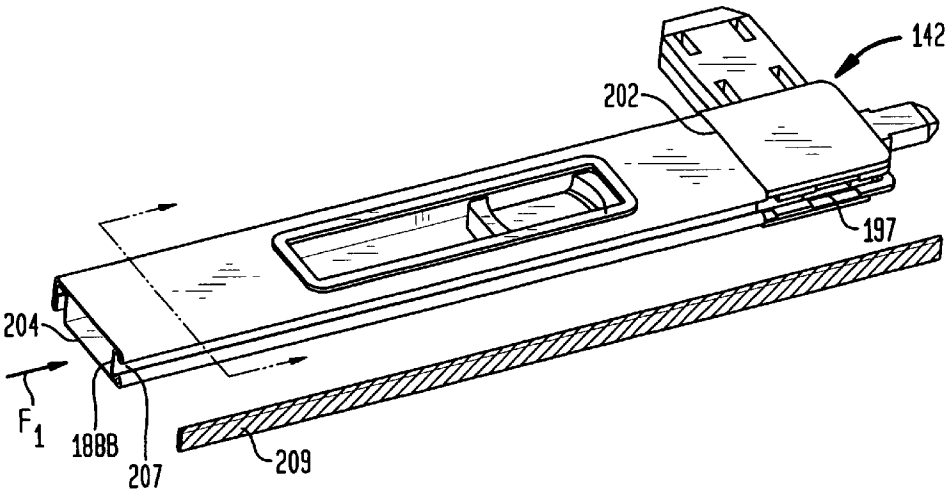
Figure 20B:
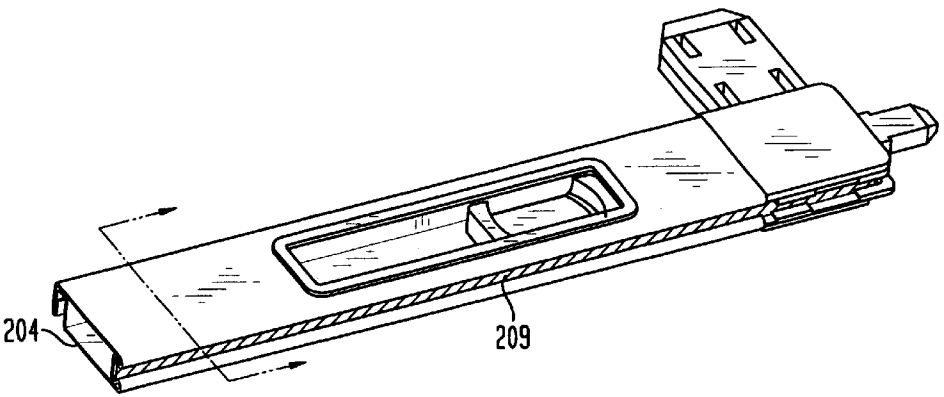

Referring to FIGS. 20A and 20A-1, in certain preferred embodiments, a T-shaped groove 207 is formed adjacent the bottom edge 188B of elongated frame member 110. The T-shaped groove 207 is adapted to receive an elongated strip 209 secured in groove 209 for providing a seal along the bottom edge 188B of elongated frame member 110. Referring to FIGS. 20A, 20A-1, 20B and 20B-1, the strip 209 may be secured within the T-shaped groove 207 by sliding strip 209 into the groove 207 at end 204 of elongated frame member 110. The strip 209 is preferably cut to a length that matches the entire length of the elongated frame member and opposing corner assemblies 142. Thus, the strip 209 will extend along the entire underside of a window frame. Although only one corner assembly is shown in FIGS. 20A and 20B, the strip 209 will preferably cover the slot openings 197 of the corner assemblies at both ends of frame member 110. The strip 209, inter alia, prevents heat transfer between peripheral edges of a movable window frame and a fixed window frame surrounding the movable window frame. The strip 209 also preferably prevents insects from entering the slot opening 197 (FIG. 20A) of corner assembly 142, and provides a more aesthetically pleasing appearance to the finished window frame product.

Although the invention herein has been described with reference to particular embodiments, it is to be understood that these embodiments are merely illustrative of the principles and applications of the present invention. For example, the frame of the present invention may be used to hold glass, plastic, a screen, or any other suitable material used in the window industry. It is therefore to be understood that numerous modifications may be made to the illustrative embodiments and that other arrangements may be devised without departing from the spirit and scope of the present invention as defined by the appended claims.

What is claimed is:

1. A frame assembly for a window opening comprising:

an elongated frame member made of roll-formed stock material having top and bottom edges, and a first wall extending between said top and bottom edges; and a latch positioned adjacent said first wall and between said top and bottom edges of said frame member, wherein said latch is slidable between extended and retracted positions, wherein said first wall includes a hole extending therethrough for providing access to said latch; and a lift inserted into said hole, wherein said lift is engageable for selectively moving said frame assembly relative to a fixed window frame.

2. The assembly as claimed in claim 1, further comprising a corner assembly for coupling a second frame member with said first frame member, wherein said corner assembly has a slot for enabling said latch to pass therethrough.

3. The assembly as claimed in claim 2, wherein said first frame member has a major axis extending between first and second ends thereof, and wherein said slot of said corner assembly extends in a direction substantially parallel to said major axis.

4. The assembly as claimed in claim 3, wherein said corner assembly has a pair of connector arms, a first one of said connector arms being insertable into said first end of said first frame member and a second one of said connector arms being insertable into a lower end of said second frame member.

5.(currently amended) The assembly as claimed in claim 1, wherein said frame member has a first end and a second end spaced therefrom, said latch being positioned adjacent said first end of said frame member, said assembly further comprising a second latch positioned adjacent said second end of said frame member for sliding between extended and retracted positions.

6. The assembly as claimed in claim 5, wherein said first wall includes said first hole extending therethrough for providing access to said first latch and a second hole extending therethrough for providing access to said second latch, said second hole extending through only said first hole.

7. The assembly as claimed in claim 6, wherein said first hole is adjacent said first end of said frame member and said second hole is adjacent said second end of said frame member.

8. The assembly as claimed in claim 1, wherein said frame member includes a second wall spaced from said first wall for defining an elongated channel, and wherein said latch is slidable in said elongated channel between said first and second walls.

9. The assembly as claimed in claim 8, wherein said second wall extends at least partially between said top and bottom edges of said frame member.

10. The assembly as claimed in claim 8, further comprising a second latch positioned in said elongated channel at an opposite end of said frame member from said first latch, wherein said second latch is slidable between said first and second walls between extended and retracted positions.

11. The assembly as claimed in claim 10, wherein said first and second walls define a first opening at a first end of said frame member for receiving said first latch and a second opening at a second end of said frame member for receiving said second latch.

12. The assembly as claimed in claim 11, wherein said first wall includes a second hole extending therethrough for providing access to said second latch, said second hole extending through only said first wall.

13. The assembly as claimed in claim 12, further comprising:

opposing side frame members positioned at opposite ends of said elongated frame member;

a first corner assembly for coupling a first one of said side frame members with said first end of said elongated frame member;

a second corner assembly for coupling a second one of said side frame members with said second end of said elongated frame member, wherein said first and second corner assemblies include respective slots for enabling said first and second latches to at least partially pass therethrough.

14. The assembly as claimed in claim 13, wherein said first corner assembly has a first connector arm insertable into said first opening of said elongated frame member and a second connector arm insertable into an opening at a lower end of said first side frame member, and said second corner assembly has a first connector arm insertable into said second opening of said elongated frame member and a second connector arm insertable into an opening at a lower end of said second side frame member.

15. The assembly as claimed in claim 1, wherein said latch includes a projection at one end, a handle spaced from said projection, and an intermediate section therebetween.

16. The assembly as claimed in claim 15, wherein said projection, said handle and said intermediate section of said latch are integrally molded together, said handle being accessible through only said hole extending through said first wall.

17. The assembly as claimed in claim 1, wherein said lift includes a wall having an aperture and said latch is positioned to pass through said aperture.

18. The assembly as claimed in claim 1, wherein said handle of said latch is at least partially surrounded by said lift.

19. The assembly as claimed in claim 1, further comprising a resilient element in contact with said latch for normally urging said latch into the extended position for holding said frame assembly in a stationary position.

20. The assembly as claimed in claim 1, wherein said stock material is sheet metal.

21. The assembly as claimed in claim 1, wherein said stock material is selected from a group of materials including aluminum and steel.

22. The assembly as claimed in claim 1, wherein said first and second walls of said frame member have a thickness of approximately 0.045–0.060 cm.

23. The assembly as claimed in claim 22, wherein said first and second walls of said frame member have a thickness of approximately 0.051–0.055 cm.

24. A window frame assembly comprising:

a top frame member, a bottom frame member, and first and second side frame members extending between said top and bottom frame members;

each said frame member being connected to an adjacent frame member by a corner assembly;

at least one of said top and bottom frame members being made of roll-formed stock material, said at least one roll-formed frame member having top and bottom edges extending between first and second ends thereof and a first wall extending between said top and bottom edges; and a latch positioned between said top and bottom edges of said roll-formed frame member, said latch being slidable between extended and retracted positions;

said first wall of said at least one roll-formed frame member including a hole extending therethrough for providing access to said latch; and a lift insertable into said hole, wherein said lift is engageable for moving said window frame assembly relative to a fixed frame of a window opening.

25. The assembly as claimed in claim 24, further comprising a second wall spaced from said first wall for defining an elongated channel, and wherein said latch is slidable in said elongated channel.

26. The assembly as claimed in claim 25, wherein said first and second walls of said roll-formed frame member are made from a unitary section of said roll-formed stock material.

27. The assembly as claimed in claim 25, further comprising a second latch positioned in said elongated channel at an opposite end of said at least one roll-formed frame member from said first latch, wherein said second latch is slidable in said elongated channel between said first and second walls.

28. The assembly as claimed in claim 27, wherein said first wall of said at least one roll-formed frame member includes a second hole extending therethrough for providing access to said second latch, said second hole extending through only said first wall.

29. The assembly as claimed in claim 28, wherein said first and second walls of said roll-formed member define a first opening at said first end thereof for receiving said first latch and a second opening at a second end thereof for receiving said second latch.

30. The assembly as claimed in claim 24, wherein said lift includes a bottom, and side walls extending upwardly from said bottom to a lip, at least one of said side walls having an aperture for enabling said latch to pass at least partially therethrough.

31. The assembly as claimed in claim 24, further comprising a resilient element in contact with said latch for normally urging said latch into said extended position.

32. The frame assembly as claimed in claim 24, wherein said latch includes a projection and a handle integrally formed therewith, said handle being accessible through only said hole extending through said first wall.

33. A frame assembly comprising:

a strip of stock material roll-formed into a frame member having spaced first and second walls extending between first and second ends thereof, said first wall of said frame member having a hole extending therethrough, said hole being located adjacent one of said ends of said frame member; and a slidable latch positioned between said first and second walls and accessible through said hole in said first wall, wherein said latch is slidable between extended and retracted positions; and a lift secured in said hole in said first wall of said frame member, wherein said lift is engageable for moving said frame assembly.

34. The frame assembly as claimed in claim 33, further comprising a corner assembly connected to a first end of said frame member, said corner assembly including a slot for enabling said latch to pass therethrough.

35. The frame assembly as claimed in claim 33, wherein said first wall of said frame member includes a second hole extending therethrough, said second hole extending through only said first wall and being located adjacent said second end of said frame member, said assembly further comprising a second latch positioned between said first and second walls and accessible through said second hole.

36. The frame assembly as claimed in claim 33, wherein said latch includes a projection and a handle integrally formed therewith, said handle being accessible through only said hole extending through said first wall.

* * * * *